US012096906B2

(12) United States Patent
Choi et al.

(10) Patent No.: US 12,096,906 B2
(45) Date of Patent: Sep. 24, 2024

(54) VACUUM CLEANER

(71) Applicant: Samsung Electronics Co., Ltd., Suwon-si (KR)

(72) Inventors: Jiwon Choi, Suwon-si (KR); Dongjun Kim, Suwon-si (KR); Byoungin Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 523 days.

(21) Appl. No.: 17/418,738

(22) PCT Filed: Dec. 13, 2019

(86) PCT No.: PCT/KR2019/017734
§ 371 (c)(1),
(2) Date: Jun. 25, 2021

(87) PCT Pub. No.: WO2020/138792
PCT Pub. Date: Jul. 2, 2020

(65) Prior Publication Data

US 2022/0061611 A1 Mar. 3, 2022

(30) Foreign Application Priority Data

Dec. 27, 2018 (KR) ..... 10-2018-0170866

(51) Int. Cl.
*A47L 9/04* (2006.01)
*A47L 7/00* (2006.01)
(Continued)

(52) U.S. Cl.
CPC ..... *A47L 9/0488* (2013.01); *A47L 9/0477* (2013.01); *A47L 9/0613* (2013.01); *A47L 11/302* (2013.01);
(Continued)

(58) Field of Classification Search
CPC .... A47L 9/0488; A47L 9/0477; A47L 9/0613; A47L 7/0066; A47L 2201/00;
(Continued)

(56) References Cited

U.S. PATENT DOCUMENTS 7,979,952 B2 7/2011 Beskow et al.
9,241,602 B2 1/2016 Lee et al.
(Continued)

FOREIGN PATENT DOCUMENTS

JP 2005211426 A 8/2005
KR 10-2010-0116860 A 11/2010
(Continued)

OTHER PUBLICATIONS

Office Action dated Jul. 31, 2023, in conjunction with Korean Patent Application No. 10-2018-0170866, 14 pages.
(Continued)

*Primary Examiner* — David Redding

(57) ABSTRACT

Disclosed is a vacuum cleaner with a drum brush. The vacuum cleaner includes: a cleaner body configured to generate suction power; and a foreign object suctionor configured to suck foreign objects by the suction power. The foreign object suctionor includes a cylindrical drum brush and a drum support configured to house a part of the drum brush and rotatably support the drum brush. The drum support includes a drum housing part configured to have a shape corresponding to an outer circumferential surface of the housed drum brush, a scraper configured to be provided in the drum housing part to remove foreign objects attached to the drum brush, and a foreign object stopper configured to be provided in one area of the drum housing part at a predetermined inflow blocking distance along a rotation direction of the drum brush from the scraper. As a result, the vacuum cleaner may effectively prevent the drum brush and
(Continued)

the scraper from being abraded or damaged by rotating with the drum brush without removing certain foreign objects.

14 Claims, 10 Drawing Sheets

(51) Int. Cl.
*A47L 9/06* (2006.01)
*A47L 11/30* (2006.01)
*A47L 11/40* (2006.01)

(52) U.S. Cl.
CPC ..... *A47L 11/4044* (2013.01); *A47L 7/0009* (2013.01); *A47L 7/0066* (2013.01)

(58) Field of Classification Search
CPC ..... A47L 9/0461; A47L 7/02; A47L 9/0606; A47L 11/302; A47L 11/4044; A47L 7/0009
See application file for complete search history.

(56) References Cited

U.S. PATENT DOCUMENTS

| | | | |
|---|---|---|---|
| 10,292,552 | B2 | 5/2019 | Lim et al. |
| 10,918,250 | B2 | 2/2021 | Lee et al. |
| 2008/0148512 | A1 | 6/2008 | Beskow et al. |
| 2010/0269290 | A1 | 10/2010 | Lee |
| 2012/0096656 | A1 | 4/2012 | Jung et al. |

FOREIGN PATENT DOCUMENTS

| | | | |
|---|---|---|---|
| KR | 20100123585 | A | 11/2010 |
| KR | 20120042642 | A | 5/2012 |
| KR | 10-2013-0025309 | A | 3/2013 |
| KR | 10-2015-0075642 | A | 7/2015 |
| KR | 10-2017-0027418 | A | 3/2017 |
| KR | 10-2018-0043148 | A | 4/2018 |

OTHER PUBLICATIONS

International Search Report dated Apr. 3, 2020 in connection with International Patent Application No. PCT/KR2019/017734, 2 pages.

VACUUM CLEANER

CROSS-REFERENCE TO RELATED APPLICATIONS

This application is a 371 of International Application No. PCT/KR2019/017734 filed on Dec. 13, 2019, which claims priority to Korean Patent Application No. 10-2018-0170866 filed on Dec. 27, 2018, the disclosures of which are herein incorporated by reference in their entirety.

BACKGROUND

1. Field

The disclosure relates to a vacuum cleaner with a drum brush.

2. Description of Related Art

A vacuum cleaner is equipped with a foreign object suctionor that has a drum brush to clean a floor where foreign objects are attached to a deep place such as a carpet. The drum brush hits targeted objects while rotating to separate foreign objects in the carpet or floor gap from the carpet or floor gap. The vacuum cleaner sucks the separated foreign objects through the foreign object suctionor. As described above, the drum brush is usefully used when suctioning foreign objects attached to a deep place between hairs of the carpet by making a suction port of the vacuum cleaner approach a surface of the carpet.

The foreign object suctionor includes a cleaning member having a cleaning brush wound around an outer circumference of the drum brush, for example, a flannel fabric and a scraper to remove foreign objects from the flannel fabric. Due to a rotating airflow generated when the drum brush rotates at high speed, dust and various foreign objects have characteristics of rotating along a rotation direction of the drum brush. The scraper provided on the outside of the drum brush is configured to minimize a gap with the drum brush. Such various foreign objects may be removed by the scraper, but hard foreign objects having a certain size may rotate along the outside of the drum brush while deforming the flannel fabric of the drum brush. These hard foreign objects that are not removed and rotate with the drum brush are introduced between the drum brush and the scraper and rotate, thereby abrading or damaging the drum brush or scraper.

An object of the disclosure is to provide a vacuum cleaner capable of not only improving durability of a drum brush and a scraper, but also improving cleaning efficiency.

SUMMARY

In an aspect, provided is a vacuum cleaner. The vacuum cleaner includes: a cleaner body configured to generate suction power; and a foreign object suctionor configured to suck foreign objects by the suction power, in which the foreign object suctionor includes: a cylindrical drum brush; and a drum support configured to house a part of the drum brush and rotatably support the drum brush, and the drum support includes: a drum housing part configured to have a shape corresponding to an outer circumferential surface of the housed drum brush; a scraper configured to be provided in the drum housing part to remove foreign objects attached to the drum brush; and a foreign object stopper configured to be provided in one area of the drum housing part at a predetermined inflow blocking distance along a rotation direction of the drum brush from the scraper.

The drum brush may include a flannel fabric on an outer periphery thereof.

The foreign object stopper may include two or more foreign object stoppers spaced apart in a rotation direction.

The two or more foreign object stoppers may be configured to increase in height along the rotation direction.

The scraper may include a contact surface that contacts the outer circumferential surface of the drum brush.

A length of the contact surface in the rotation direction may be 2 to 3 mm.

The contact surface may be configured to extend in a direction parallel to the outer circumferential surface of the drum brush or outwardly of the outer circumferential surface.

The vacuum cleaner may further include: a foreign object housing part configured to be provided between the scraper and the foreign object stopper to house the foreign objects.

The inflow blocking distance may correspond to an outer diameter of the drum brush.

The inflow blocking distance may be 7 to 9 mm.

The foreign object stopper may include an inclined surface facing the scraper and extending toward the center of the drum brush.

The foreign object stopper or the scraper may be configured to extend along a longitudinal direction of the drum brush.

The scraper or the foreign object stopper may be integrally formed in the drum housing part.

The drum support may include a foreign object collector adjacent to the drum housing part and having a space that collects the foreign objects, and the scraper may be provided at a corner of the drum housing part adjacent to the foreign object collector.

The scraper or the foreign object stopper may be provided to overlap an outer circumferential surface of the drum brush.

According to the vacuum cleaner of the disclosure, the foreign object stopper may prevent some of the foreign objects from penetrating deeply between the drum brush and the scraper when many foreign objects are introduced simultaneously, thereby preventing the drum brush and the scraper from being abraded and damaged.

In addition, the conditions of the drum brush may be improved because the dust remaining in the drum brush without being sucked may be removed by the scraper and then removed by the foreign object stopper.

In addition, the scraper overlaps the outer periphery of the drum brush, and thus, it is possible to prevent the scraper from being damaged even when irregular and hard foreign objects are introduced through the surface contact, not through the line contact.

DETAILED DESCRIPTION

Hereinafter, a vacuum cleaner 1 according to the disclosure will be described in detail with reference to the accompanying drawings. Embodiments described below describe that the vacuum cleaner 1 is applied to a robot vacuum cleaner to aid understanding of the disclosure, which is illustrative. Unlike the embodiments described herein, it should be understood that the vacuum cleaner 1 may be implemented in various modifications such as a canister type vacuum cleaner, an upright type vacuum cleaner, and a stick type vacuum cleaner. However, when it is decided that a detailed description for the known functions or components related to the disclosure may obscure the gist of the disclosure, the detailed description and concrete illustration will be omitted.

Figure 1:
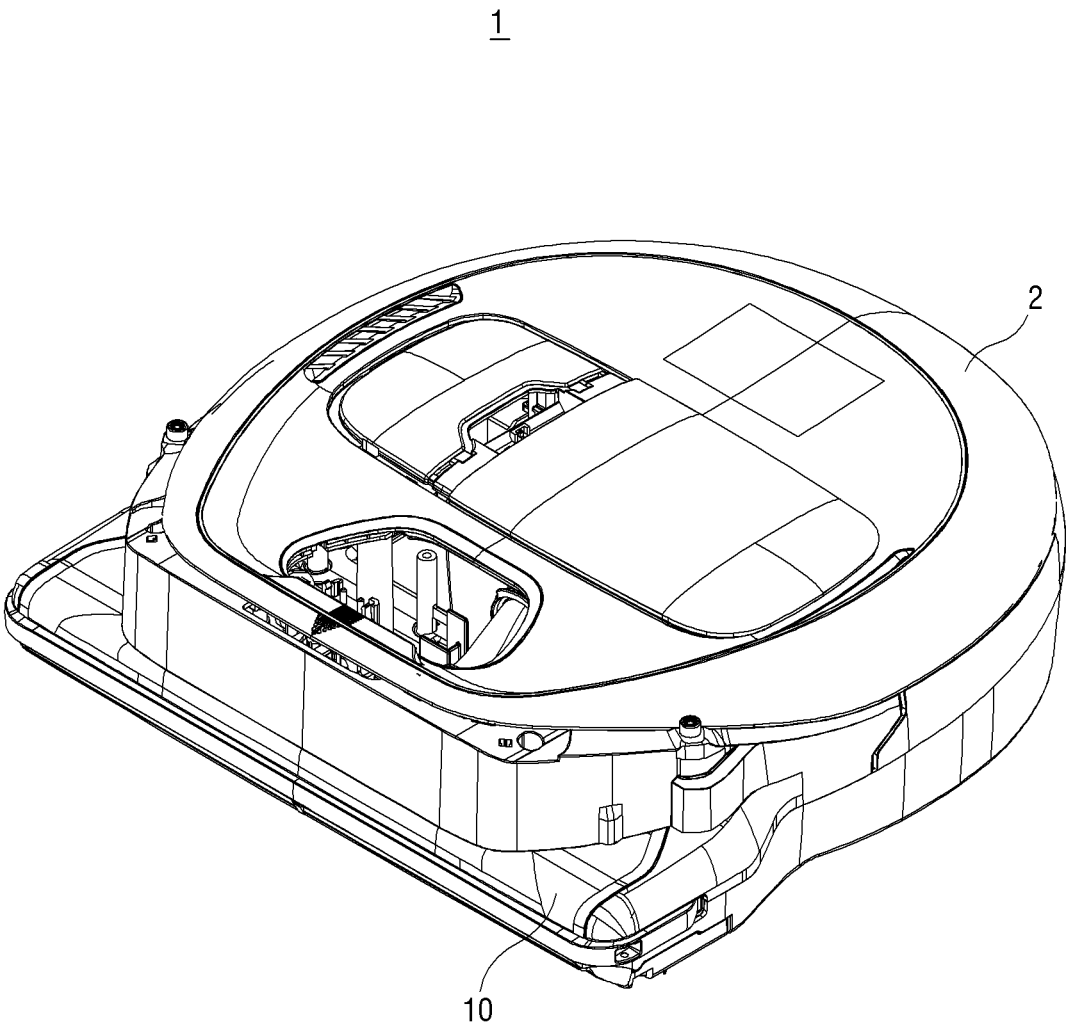
FIGS. 1 and 2 are a top perspective view and a bottom perspective view of a vacuum cleaner according to an embodiment of the disclosure, respectively.

FIG. 1 is a perspective view of a vacuum cleaner according to an embodiment of the disclosure. The vacuum cleaner 1 according to the embodiment of the disclosure includes a cleaner body 2 that generates suction power and a foreign object suctionor 10.

The cleaner body 2 includes a suction motor (not illustrated) that generates suction power and a dust collector (not illustrated).

The suction motor generates a predetermined suction power to suck dirt on a cleaned surface.

The dust collector may collect dirt sucked into the cleaner body 2 through the foreign object suctionor 10 by the suction power. The dust collector may include a filter that filters foreign objects sucked by the suction power. The dust collector may include a cyclone structure that separates dirt from sucked air using a centrifugal force.

In the vacuum cleaner 1, when negative pressure is generated in a suction passage by the suction motor, the negative pressure is also formed in the foreign object suctionor 10. Therefore, foreign objects (foreign objects, dirt, hair, etc.) of the cleaned surface are sucked by a flow of air due to a pressure difference from an outer periphery of the foreign object suctionor 10. In general, when foreign objects are attached to a material such as a carpet (not illustrated), it is difficult to suck foreign objects deeply attached to an inside of the carpet only by suction of air. Therefore, the drum brush 11 scatters and sucks foreign objects to an upper portion of the carpet by removing foreign objects that are deeply attached between a plurality of hairs of the carpet.

Figure 2:
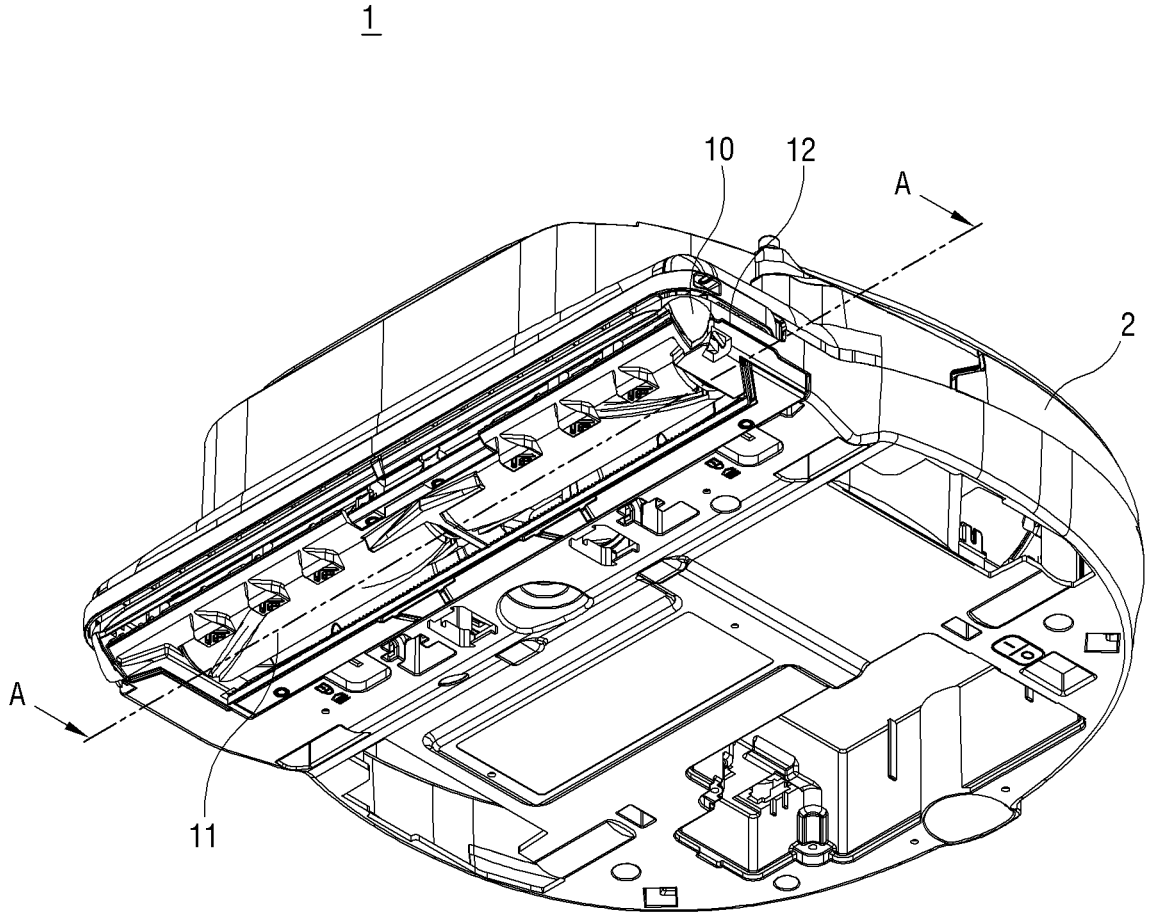

Referring to FIG. 2, the foreign object suctionor 10 includes a cylindrical drum brush 11 that rotates at high speed and a drum support 12 that rotatably supports the drum brush 11. The drum brush 11 may be partially exposed to a floor and contact a cleaning surface, and thus remove foreign objects while rotating.

Figure 3:
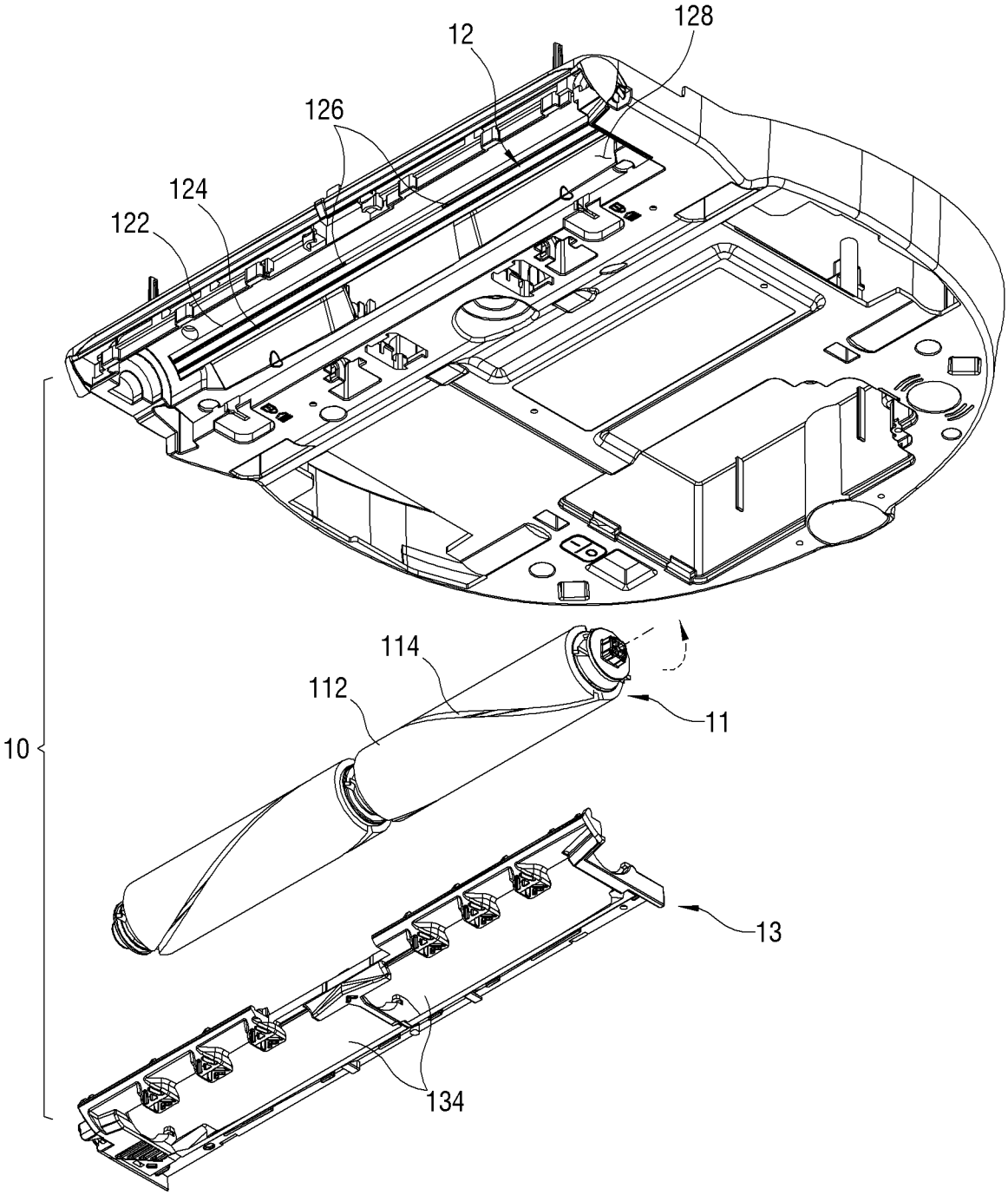
FIG. 3 is an exploded view of a foreign object suctionor according to an embodiment of the disclosure.
Figure 4:
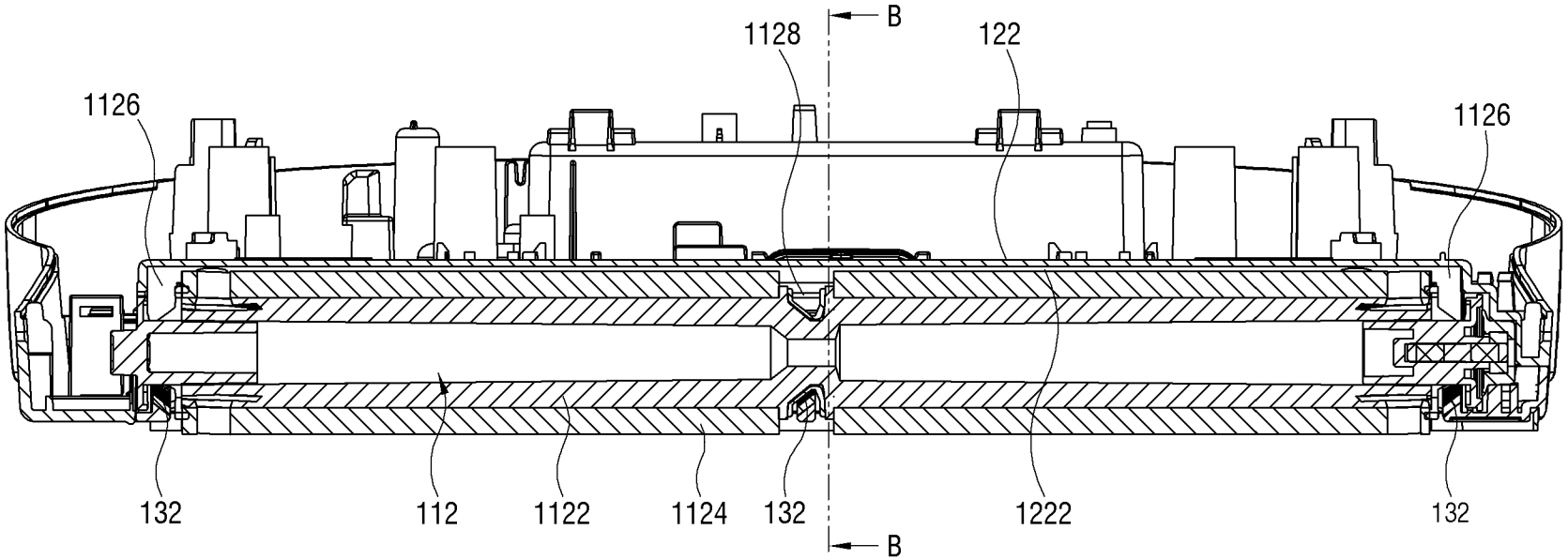
FIG. 4 is a cross-sectional view taken along line A-A of FIG. 2.

FIG. 3 is an exploded perspective view of a foreign object suctionor 10 according to the embodiment of the disclosure, and FIG. 4 is a cross-sectional view taken along line A-A of FIG. 2.

Referring to FIGS. 3 and 4, the foreign object suctionor 10 may include a drum brush 11, a drum support 12, and a base member 13.

The drum brush 11 includes a rotating body 112 and a nozzle 114 that is provided in a spiral shape along the longitudinal direction of the rotating body 112 to guide foreign objects.

The rotating body 112 includes a cylindrical drum core 1122 that rotates along a rotation shaft in the longitudinal direction, a cleaning brush 1124 that surrounds an outer circumferential surface of the drum core 1122 and is made of, for example, flannel fabric, a pair of foreign object collection groove parts 1126 that are provided at both end portions of the drum core 1122, and an intermediate foreign object collection groove part 1128 that is provided in the middle of the drum core 1122.

The nozzle 114 is made of a rubber material and is provided on the rotating body 112 in a spiral shape. The nozzle 114 separates foreign objects attached to the cleaned surface by friction that is generated by rotation.

The drum support 12 includes a drum housing part 122 that houses the drum brush 11, a scraper 124 that removes foreign objects attached to the drum brush 11, and a foreign object stopper 126 that prevents the inflow of foreign objects, and a foreign object collector 128.

The drum housing part 122 rotatably supports both end portions of the drum brush 11 while housing a part of the outer circumferential surface of the drum brush 11. The drum housing part 122 and the outer circumferential surface of the drum brush 11 have a gap 1222. Of course, the drum housing part 122 and the outer peripheral surface of the drum brush 11 may contact each other. The drum housing part 122 communicates with the foreign object collector 129 adjacent thereto.

The scraper 124 extends long along the longitudinal direction of the drum brush 11 at a corner of one side of the drum housing part 122 (adjacent to the foreign object collector). The scraper 124 protrudes from the drum housing part 122 toward the gap 1222 and is spaced apart from the outer circumferential surface of the drum brush 11 by a predetermined distance, contacts the outer circumferential surface thereof, or overlaps the outer circumferential surface thereof. As a result, the scraper 124 removes foreign objects attached to the rotating drum brush 11 to prevent the foreign objects from being introduced into the gap 1222 and suck the foreign objects into the foreign object collector 128 by the suction power. A detailed description of the scraper 124 will be described in detail later with reference to separate drawings.

The foreign object stopper 126 is provided in one area of the drum housing part 122 at a predetermined inflow blocking distance along the rotation direction (counterclockwise direction) of the drum brush 11 from the scraper 124. The foreign object stopper 126 extends long along the longitudinal direction of the drum brush 11. In the foreign object stopper 126, the foreign object stopper 126 is not formed in a central portion of the drum housing part 122. This is to prevent foreign objects from being trapped and accumulated between the scraper 124 and the foreign object stopper 126. A detailed description of the foreign object stopper 126 will be described in detail later with reference to separate drawings.

The foreign object collector 128 generates negative pressure by interlocking with the suction power of the cleaner body 2. The foreign object collector 128 collects various foreign objects blown in the rotation direction according to the high-speed rotation of the drum brush 11. The foreign object collector 128 collects foreign objects attached to the drum brush 11, which is removed by the scraper 124.

The base member 13 covers a lower portion of the foreign object suctionor 10. The base member 13 includes three grinders (132 in FIG. 4) and a pair of lower drum housing parts (134 in FIG. 3) that houses the lower portion of the rotating body 122.

The grinder 132 is disposed adjacent to the foreign objects collection groove part 1126 and the intermediate foreign object collection groove part 1128 of the rotating body 112 to crush the collected foreign objects.

In the lower drum housing part 134, a part of the rotating body 112 is exposed downward to contact the cleaned surface.

Figure 5:
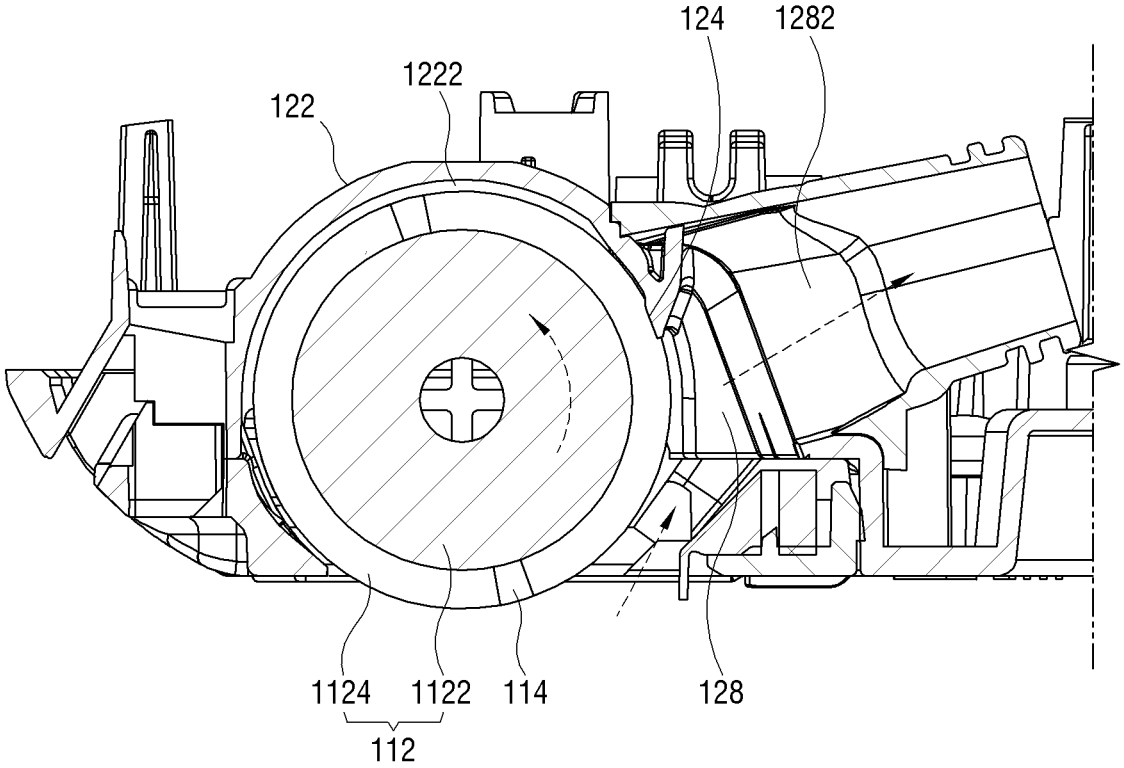
FIG. 5 is a cross-sectional view taken along line B-B of FIG. 4.

FIG. 5 is a cross-sectional view taken along line B-B of FIG. 4. As illustrated, the drum brush 112 rotates at high speed in a counterclockwise direction with a predetermined gap 1222 in the substantially semi-cylindrical drum housing part 122. In this case, the foreign objects on the floor are collected in the foreign object collector 128 while rotating counterclockwise according to a torque of the drum brush 112. Thereafter, foreign objects attached to the cleaning brush 1124, such as the flannel fabric mounted on the outer periphery of the drum brush 112, are removed by the scraper 124 provided at a position adjacent to the foreign object collector 128, and are collected in the foreign object collector 128. According to one embodiment, the scraper 124 somewhat overlaps the outer circumferential surface of the drum brush 112 in order to increase the efficiency of removing foreign objects. The foreign objects collected in this way are sucked into the suction passage 1282 where negative pressure is generated by the suction power of the cleaner body 2. The foreign object stopper 126 is not illustrated in FIG. 5. As illustrated in FIG. 3, the reason is that the foreign object stopper 126 is not formed in the central portion of the drum brush 112. Of course, the foreign object stopper 126 may be formed in the central portion thereof.

Figure 6:
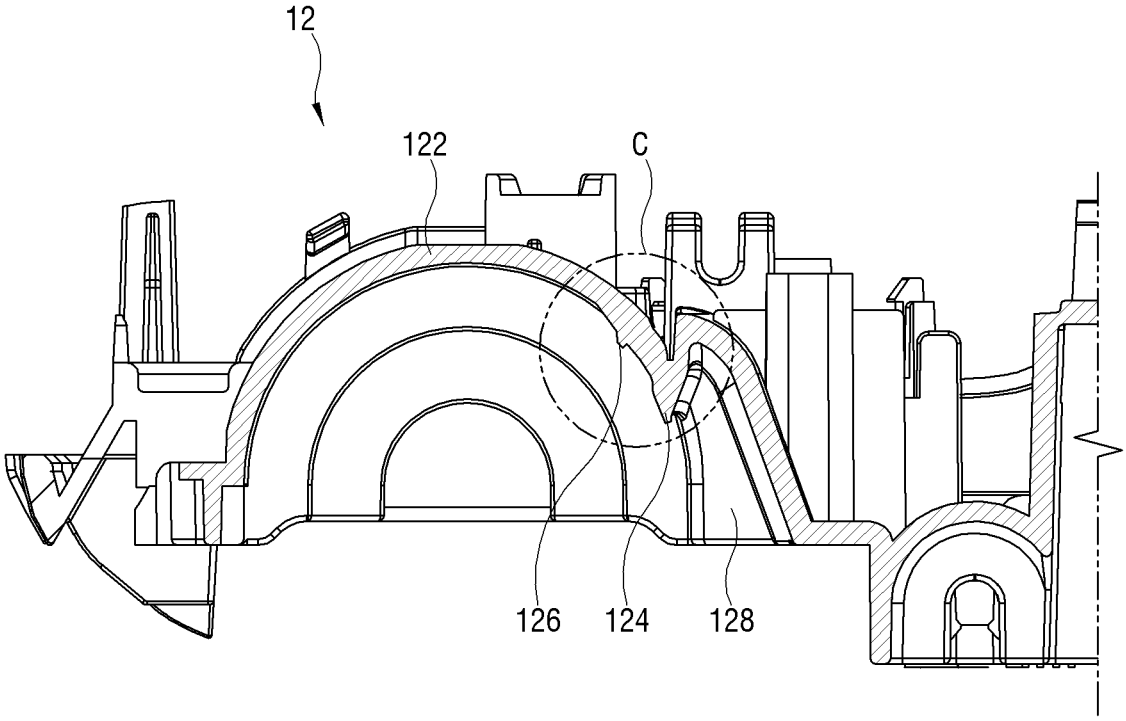
FIG. 6 is a cross-sectional view of a drum support according to an embodiment of the disclosure.
Figure 7:
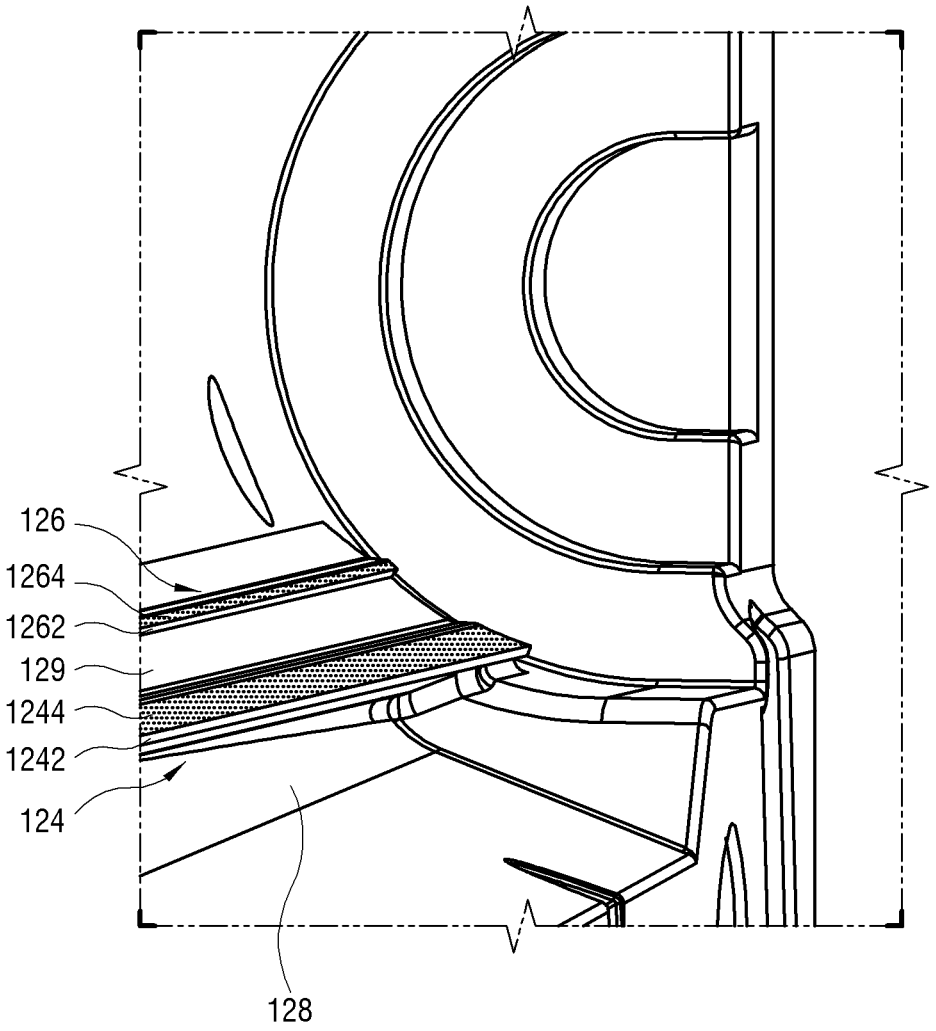
FIG. 7 is an enlarged view of part C of FIG. 6.
Figure 8:
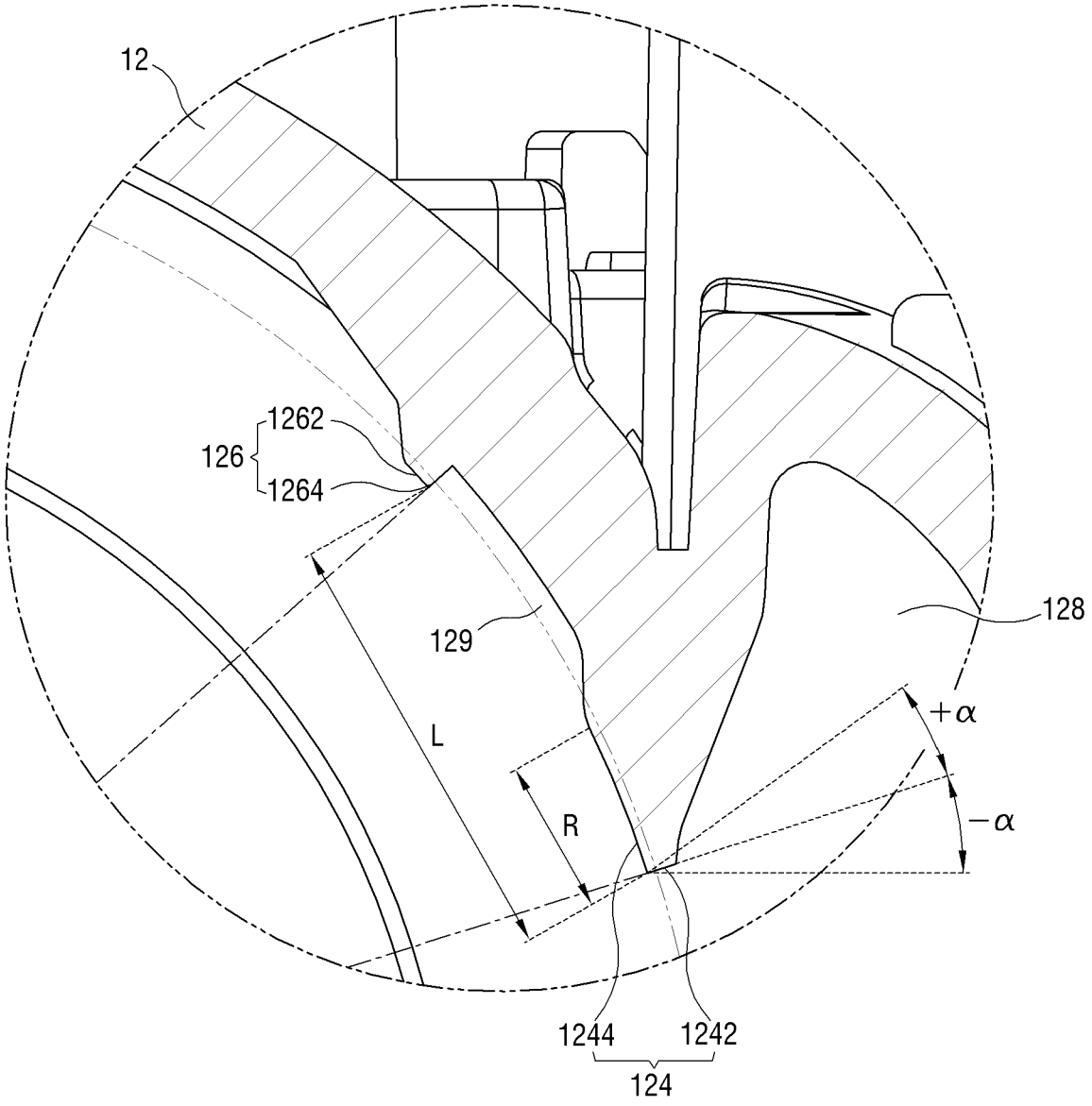
FIG. 8 is an enlarged perspective view illustrating a part of the drum support.

FIG. 6 is a cross-sectional view illustrating the drum support 12 according to the embodiment of the disclosure, FIG. 7 is an enlarged view of part C of FIG. 6, and FIG. 8 is a partially enlarged perspective view of the drum support 12.

The drum support 12 includes the substantially semi-cylindrical drum housing part 122, the scraper 124 that protrudes toward the outer circumferential surface of the drum brush 11, the foreign object stopper 126 that protrudes toward the outer circumferential surface of the drum brush 11 at a position spaced apart by a predetermined inflow blocking distance L in the rotation direction of the drum brush 11 from the scraper 124, that is, in the counterclockwise direction, and the foreign object collector 128 adjacent to the scraper 124.

Referring to FIGS. 7 and 8, the scraper 124 includes a first inclined surface 1242 toward a central axis of the drum brush 11 and a first contact surface 1244 parallel to the outer circumferential surface of the drum brush 11. The foreign object stopper 126 includes a second inclined surface 1262 toward the central axis of the drum brush 11 and a second contact surface 1264 parallel to the outer circumferential surface of the drum brush 11. The foreign object housing part 129 having a predetermined space is provided between the scraper 124 and the foreign object stopper 126, that is, between the first inclined surface 1242 and the second inclined surface 1262. End portions of the scraper 124 and the foreign object stopper 126 are positioned to somewhat overlap the outer periphery of the drum brush 11.

The first inclined surface 1242 does not necessarily have to be perpendicular to the tangent line of the outer circumferential surface of the drum brush 11 and may extend at an angle of $\pm\alpha$ based on the vertical. However, when $+\alpha$ is too large, the end portion is too sharp, so the efficiency of removing foreign objects is improved, but the durability of the scraper 124 or the drum brush 11 deteriorates. On the other hand, when $-\alpha$ is too large, the end portion is too smooth, so the efficiency of removing foreign objects deteriorates, but the durability of the scraper 124 or the drum brush 11 is improved.

The first contact surface 1244 contacts the foreign objects and guides the foreign objects to be caught on the second inclined surface 1262 of the foreign object stopper 126. The first contact surface 1244 need not be parallel to the outer circumferential surface of the drum brush 11 and may extend outward based on a tangent surface of the outer circumferential surface of the drum brush 11. When the first contact surface 1244 extends outward with respect to the outer circumferential surface, the foreign object housing part 129 is formed so that the foreign objects are easily caught on the foreign object stopper 126. That is, it is easy for the ends of the foreign objects extending in contact with the first contact surface 1244 to be caught on the second inclined surface 1262 of the foreign object stopper 126. When the first contact surface 1244 extends inward based on the tangent surface, foreign objects extending in contact with the first contact surface 1244 may be introduced without being caught by the foreign object stopper 126. The first contact surface 1244 may have a length R of 2.5 mm or more in the extending direction toward the foreign object stopper 126.

Similar to the first inclined surface 1242, the second inclined surface 1262 does not necessarily have to be vertical to the tangent line of the outer circumferential surface of the drum brush 11 and may extend obliquely based on the vertical. However, when the second inclined surface is inclined too inward, the end portion is too sharp and the durability of the scraper 124 or the drum brush 11 deteriorates. On the other hand, when the second inclined surface is too inclined outward, the end portion is too smooth and the efficiency of catching foreign objects deteriorates, but durability of the scraper 124 or the drum brush 11 is improved.

The second contact surface 1264 need not be parallel to the outer circumferential surface of the drum brush 11 and may extend outward based on the tangent surface of the outer circumferential surface of the drum brush 11. When the second contact surface 1264 extends outward from the outer circumferential surface of the drum brush 11, the amount of overlap with the outer circumferential surface of the drum brush 11 decreases to reduce the frictional force, so a rotational load of the drum brush 11 may decrease. On the other hand, when the second contact surface 1264 extends inward based on the outer circumferential surface of the drum brush 11, the amount of overlap with the outer circumferential surface of the drum brush 11 increases to increase the frictional force, so the rotational load of the drum brush 11 may increase and the abrasion of the drum brush 11 may increase. The length of the second contact surface 1264 is preferably as short as possible as long as there is no problem in durability.

The inflow blocking distance L formed by the scraper 124 and the foreign object stopper 126 is set corresponding to an outer diameter of the drum brush 11. As the outer diameter of the drum brush 11 increases, the size of foreign objects that may be introduced also increases, so the inflow blocking distance (L) needs to be set large as well. The inflow blocking distance L is 7 to 9 mm, preferably 8 mm.

Figure 9:
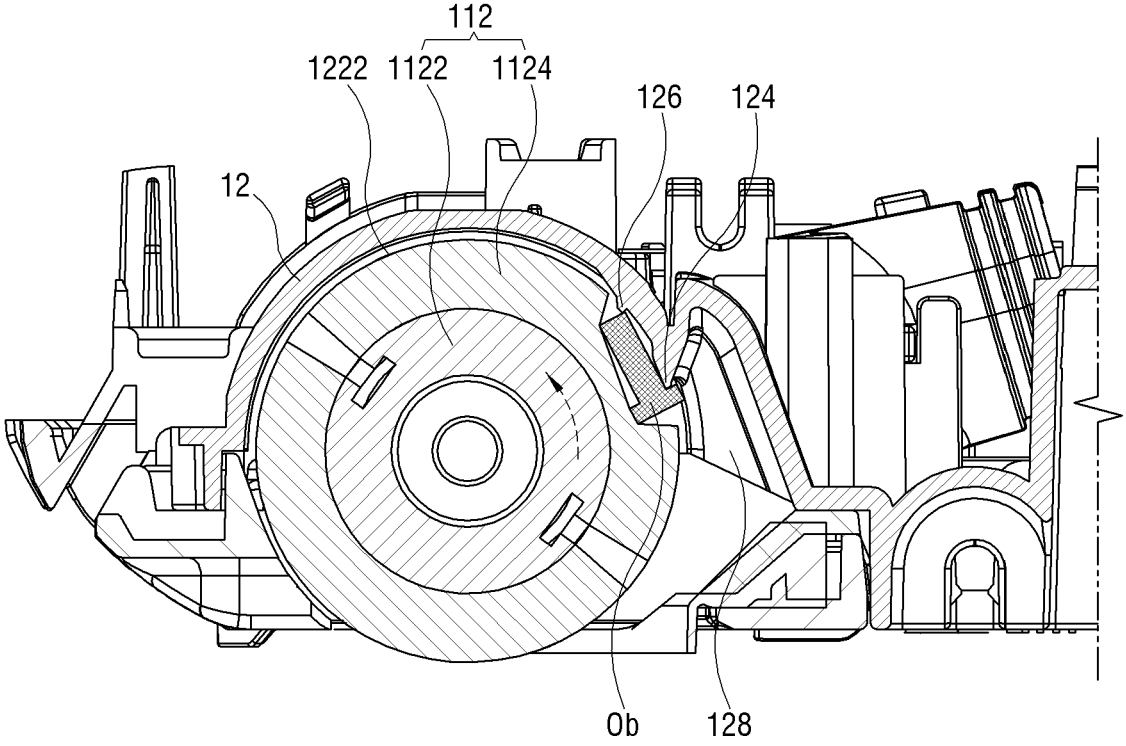
FIG. 9 is a cross-sectional view illustrating a state in which an inflow of foreign objects stops in the foreign object suctionor according to an embodiment of the disclosure.

FIG. 9 is a cross-sectional view illustrating a state in which a foreign object Ob is caught by the foreign object stopper 126 in the foreign object suctionor 10 according to the embodiment of the disclosure. As illustrated, the foreign object Ob is introduced into the gap 1222 without being caught on the scraper 124 while attached to the cleaning brush 1124. Thereafter, the introduced foreign object Ob is caught by the foreign object stopper (126), and as a result, the rotation of the drum brush 11 stops. The vacuum cleaner 1 according to the embodiment of the disclosure may further include a rotation detection sensor (not illustrated) that detects the rotation of the drum brush 11 and an alarm output device (not illustrated). The vacuum cleaner 1 detects that the foreign objects are caught on the foreign object stopper 126 by the rotation detection sensor to stop the rotation of the drum brush 11, and outputs an alarm (sound and light) to a user. After the user determines that foreign objects are caught by the alarm, the foreign objects are manually removed, and thus, hard foreign objects are forcibly introduced into the gap 1222, thereby preventing the scraper 124 or the drum brush 11 from being abraded or damaged.

Figure 10:
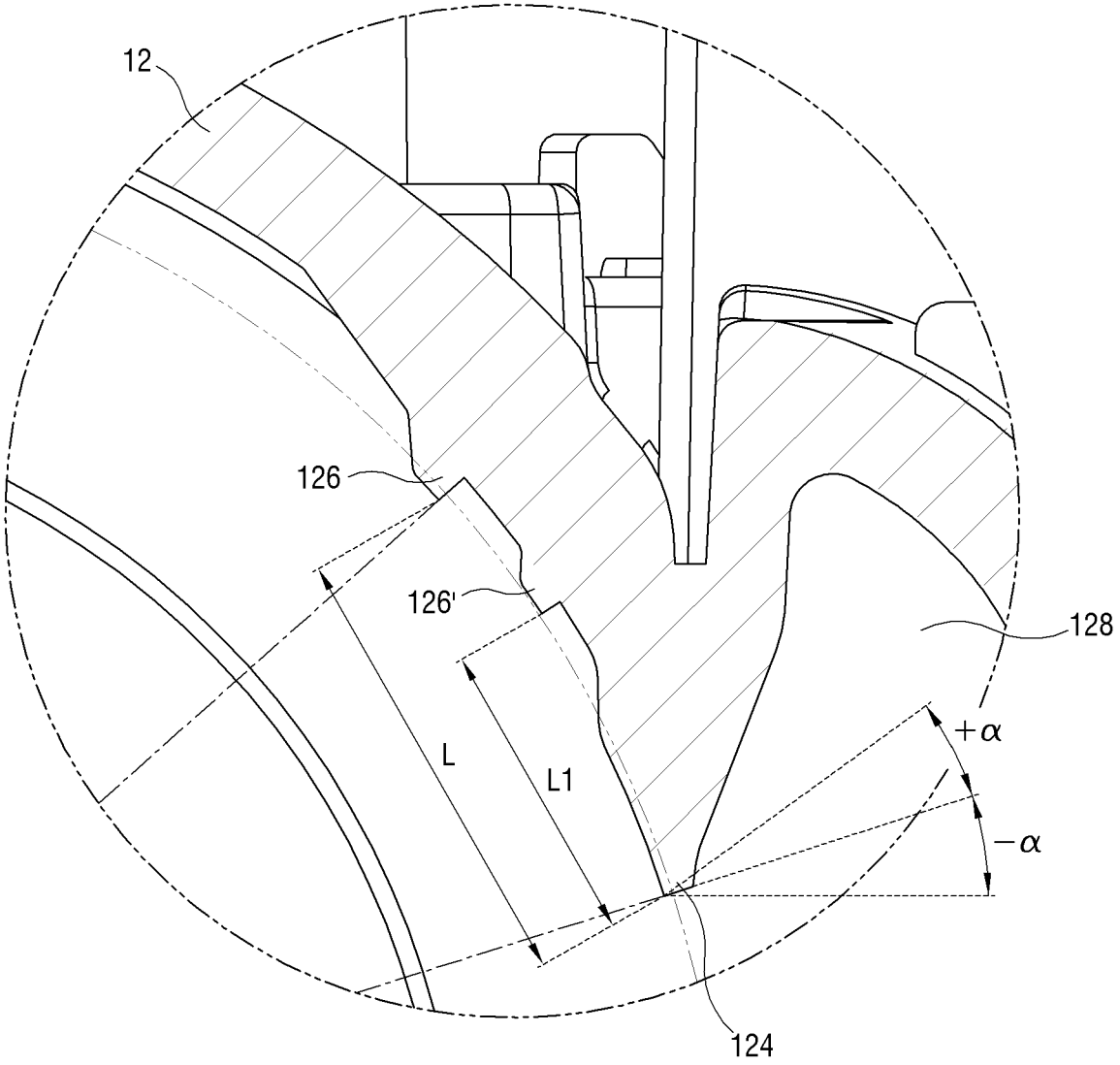
FIG. 10 is a partial enlarged view of a drum support according to another embodiment of the disclosure.

FIG. 10 is a partial enlarged view of the drum support 12 according to another embodiment of the disclosure. As illustrated, the drum support 12 includes the scraper 124 provided adjacent to the foreign object collector 128, the foreign object stopper 126 provided at a predetermined inflow blocking distance L1 counterclockwise from the scraper 124, and a second foreign object stopper 126' provided at a second inflow blocking distance L2 shorter than the inflow blocking distance L1. A height of the second foreign object stopper 126' is lower than that of the foreign object stopper 126. In this way, by providing the plurality of foreign object stoppers 126' and 126 at different distances from the scraper 124, foreign objects having various sizes may be filtered out.

In this way, according to the vacuum cleaner of the disclosure, it is possible to prevent the scraper or the drum brush from being damaged by rotating large and hard foreign objects together with the drum brush.

Although the preferred embodiments of the disclosure have been illustrated and described above, the disclosure is not limited to the specific embodiments described above, and can be variously modified by those skilled in the art to which the disclosure pertains without departing from the gist of the disclosure claimed in the claims, and these modifications should not be understood individually from the technical ideas or prospects of the disclosure.

The invention claimed is:

1. A vacuum cleaner, comprising:

a cleaner body configured to generate suction power; and a foreign object suctionor configured to suck foreign objects by the suction power, wherein the foreign object suctionor includes:

a cylindrical drum brush; and a drum support configured to house a part of the drum brush and rotatably support the drum brush, and the drum support includes:

a drum housing part configured to have a shape corresponding to an outer circumferential surface of the housed drum brush;

a scraper configured to be provided in the drum housing part to remove foreign objects attached to the drum brush; and a foreign object stopper configured to be provided in one area of the drum housing part at a predetermined inflow blocking distance along a rotation direction of the drum brush from the scraper, wherein the scraper comprises:

a contact surface configured to extend in a direction parallel to the outer circumferential surface of the drum brush, and an inclined surface facing a center of the drum brush and inclined within a predetermined angular range with respect to a surface perpendicular to the tangent line of the outer circumferential surface of the drum brush.

2. The vacuum cleaner of claim 1, wherein the drum brush includes a flannel fabric on an outer periphery thereof.

3. The vacuum cleaner of claim 1, wherein the foreign object stopper includes two or more foreign object stoppers spaced apart in a rotation direction.

4. The vacuum cleaner of claim 3, wherein the two or more foreign object stoppers are configured to increase in height along the rotation direction.

5. The vacuum cleaner of claim 1, wherein the contact surface is configured to contact the outer circumferential surface of the drum brush.

6. The vacuum cleaner of claim 5, wherein a length of the contact surface in the rotation direction is 2 to 3 mm.

7. The vacuum cleaner of claim 1, further comprising:

a foreign object housing part configured to be provided between the scraper and the foreign object stopper to house the foreign objects.

8. The vacuum cleaner of claim 1, wherein the inflow blocking distance corresponds to an outer diameter of the drum brush.

9. The vacuum cleaner of claim 8, wherein the inflow blocking distance is 7 to 9 mm.

10. The vacuum cleaner of claim 1, wherein the foreign object stopper includes an inclined surface facing the scraper and extending toward the center of the drum brush.

11. The vacuum cleaner of claim 1, wherein the foreign object stopper or the scraper is configured to extend along a longitudinal direction of the drum brush.

12. The vacuum cleaner of claim 1, wherein the scraper or the foreign object stopper is integrally formed in the drum housing part.

13. The vacuum cleaner of claim 1, wherein the drum support includes a foreign object collector adjacent to the drum housing part and having a space that collects the foreign objects, and the scraper is provided at a corner of the drum housing part adjacent to the foreign object collector.

14. The vacuum cleaner of claim 1, wherein the scraper or the foreign object stopper is provided to overlap an outer circumferential surface of the drum brush.

* * * * *